US005484379A

United States Patent [19]

Stäb

[11] Patent Number: 5,484,379

[45] Date of Patent: Jan. 16, 1996

[54] FOLDER ASSEMBY FOR PRINTING PRESS

[75] Inventor: Rudolf Stäb, Frankentahl, Germany

[73] Assignee: Albert-Frankenthal Aktiengesellschaft, Wurzburg, Germany

[21] Appl. No.: 114,617

[22] Filed: Sep. 1, 1993

[30] Foreign Application Priority Data

Sep. 1, 1992 [DE] Germany ..... 42 29 059.7

[51] Int. Cl.[6] ..... B41F 13/56; B42C 1/04

[52] U.S. Cl. ..... 493/359; 83/155; 270/21.1

[58] Field of Search ..... 270/4, 6, 10, 19, 270/21.1; 493/359, 360, 416, 425, 426, 427, 428, 429, 430, 431, 432, 357; 198/835, 836.1; 83/155

[56] References Cited

U.S. PATENT DOCUMENTS

| | | | |
|---|---|---|---|
| 3,999,454 | 12/1976 | Tiso et al. | 270/21.1 |
| 4,036,487 | 6/1977 | Heimlicher et al. | 493/428 |
| 4,957,280 | 9/1990 | Motooka | 270/21.1 |
| 4,983,155 | 1/1991 | Stobb | 83/155 |
| 5,004,451 | 4/1991 | Prum | 493/359 |
| 5,230,268 | 6/1993 | Richter | 83/155 |

FOREIGN PATENT DOCUMENTS

| | | |
|---|---|---|
| 6925525 | 6/1969 | Germany . |
| 1611292 | 10/1973 | Germany . |
| 2533432 | 3/1976 | Germany . |
| 3628411 | 2/1988 | Germany . |

*Primary Examiner*—Jack W. Lavinder
*Assistant Examiner*—Christopher W. Day
*Attorney, Agent, or Firm*—Jones, Tullar & Cooper

[57] ABSTRACT

A folder for a web-fed rotary printing press includes a cooperating pair of collection and cutting cylinders to sever a paper web into web segments. A belt conveyor system enwraps a portion of the surface of the collection cylinder just before an intake point of the paper ribbon between the collection cylinder and the cutting cylinder. This belt conveyor system prevents the newly created leading edge of the paper ribbon from springing back.

5 Claims, 1 Drawing Sheet

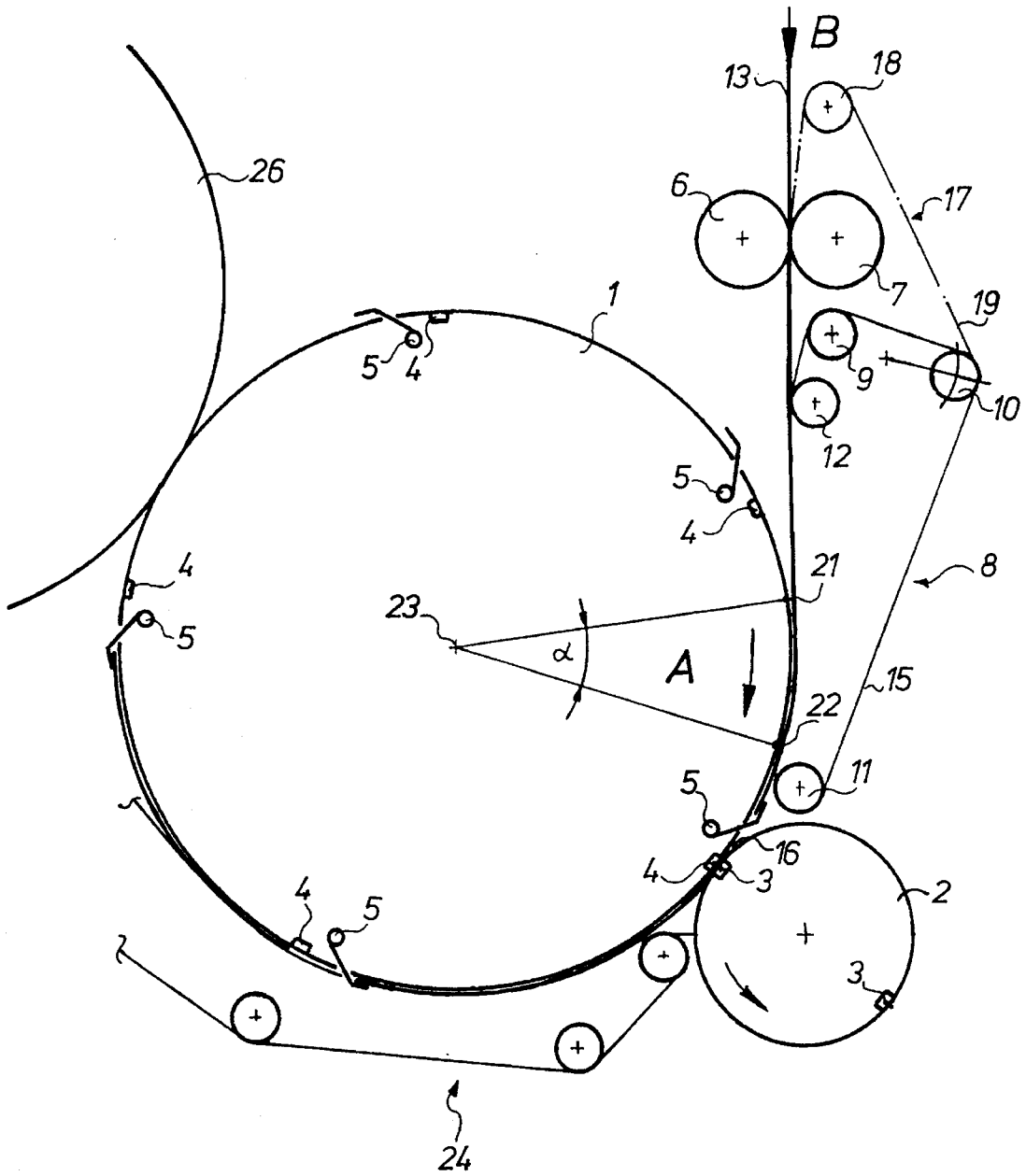
B
13
18
26
6
17
7
1
19
5
4
9
10
12
5
4
21
8
4
23
5
α
A
15
22
11
5
16
4
3
2
4
5
3
24

FOLDER ASSEMBY FOR PRINTING PRESS

FIELD OF THE INVENTION

The present invention is directed generally to a folder assembly for a printing press. More particularly, the present invention is directed to a folder assembly for a rotary printing press. Most specifically, the present invention is directed to a folder assembly for a web-fed rotary printing press. A cutting cylinder cooperates with a collection cylinder to cross-cut a paper ribbon into segments which are then folded by a folding jaw cylinder. The paper ribbon is held against the surface of the collection cylinder by a belt conveyor assembly that wraps about a portion of the surface of the collection cylinder. This belt conveyor system prevents the forward most portion of the unsevered paper ribbon from springing back after the ribbon has been cut by the cutting cylinder.

DESCRIPTION OF THE PRIOR ART

In the production of printed products in a web-fed rotary printing press, the continuous paper ribbon, after having been printed by the printing couples of the printing press, is cross-cut into ribbon segments which are then folded into signatures. Various folder assemblies are utilized to effect this cross-cutting and folding. A variable folder that is usable with web-fed rotary printing presses is shown in German Patent No. DE-PS 16 11 292. In this apparatus, the folder has a knife or cutting cylinder which cooperates with a collection cylinder. The printed paper ribbon is fed between the cutting cylinder and the collection cylinder and passes between drawing rollers and across sheet guides. The paper ribbon is cut into segments which are then guided along the collection cylinder to a folding jaw cylinder by a conveyor belt. This collection cylinder, with its cutting groove devices, gripping devices and folding knife devices, can be adjusted to accommodate a variety of paper ribbon formats; i.e. the individual functional units can be adjusted to fit various formats. This results in differences in speed as a consequence of higher circumferential speeds of the collection cylinder, particularly when smaller formats are being handled, and because of the lower speed of the fed product ribbon.

These differences in speed cause a prestressing of the paper ribbon prior to its being cross-cut by the cutting cylinder. This prestressing can result in a slackening of the speed of the paper ribbon during cutting. The leading edge of the uncut paper ribbon; i.e. the part of the ribbon just before, in the direction of ribbon travel of the last ribbon engaging cutting knife on the cutting blade cylinder, can spring out of the intake point or clamping point between the cutting and collection cylinders. Even the sheet guides which, as shown in German Patent No DE-PS 16 11 292 are disposed between the drawing rollers and the intake point between the knife cylinder and the collection cylinder, are not able to completely prevent the now leading edge of the uncut paper ribbon from springing back. This movement of the leading edge of the uncut paper ribbon back, opposite to the intended direction of web or ribbon travel, requires the provision of greater folder tolerances. In some instances malfunctions of the folder may result because of so-called "plugs".

It will thus be apparent that a need exists for a folder which overcomes these limitations of the prior art. The folder assembly for web-fed rotary printing presses in accordance with the present invention provides such a device and is a significant improvement over the prior art devices.

SUMMARY OF THE INVENTION

It is an object of the present invention to provide a folder assembly for a printing press.

Another object of the present invention is to provide a folder assembly for a rotary printing press.

A further object of the present invention is to provide a folder assembly for a web-fed rotary printing press.

Even another object of the present invention is to provide a folder assembly having a cutting cylinder and a collection cylinder through which a prestressed paper ribbon is fed.

Still a further object of the present invention is to provide a folder assembly for a printing press which prevents the uncut paper ribbon from springing back after being Yet even another object of the present invention is to provide a folder assembly that is usable with large collection cylinders that can be adjusted to various formats.

As will be discussed in detail in the description of the preferred embodiment which is set forth subsequently, the folder assembly for a printing press in accordance with the present invention utilizes a cutting cylinder, which works with a collection cylinder, to sever a paper ribbon into a plurality of ribbon segments. The cut segments are then guided by a conveyor belt to a folding Jaw cylinder. The collection cylinder is adjustable to accommodate various formats and this adjustability, in conjunction with the use of the conveyor belt, imparts a prestress to the uncut paper ribbon. In accordance with the present invention, a belt conveyor assembly is placed adjacent the collection cylinder prior to an intake point between the collection cylinder and the cutting blade cylinder. This belt conveyor assembly wraps around an arcuate portion of the collection cylinder and firmly holds the leading portion of the uncut paper ribbon. As the ribbon is cut by the cutting cylinder and the collection cylinder, the belt conveyor assembly prevents the now-leading edge of the uncut paper ribbon from springing back against the direction of web travel.

The folder assembly for printing presses in accordance with the present invention has several advantages over the prior art devices. The arrangement of the belt conveyor system adjacent and in engagement with the collection cylinder through a wrap angle prior to the intake point of the paper ribbon between the collection cylinder and the cutting knife cylinder prevents the newly created leading edge of the prestressed paper ribbon from springing back after the prior leading portion of the ribbon has been cut to form a ribbon segment. Since the new leading edge of the uncut paper ribbon is held firmly against the collection cylinder by the belt conveyor assembly, it cannot spring back. The prevention of this spring back of the paper ribbon allows the folder to operate at closer tolerances and eliminates "plugs" which might otherwise be formed.

The folder assembly in accordance with the present invention overcomes the limitations of the prior art device. It is a substantial advance in the art.

BRIEF DESCRIPTION OF THE DRAWINGS

While the novel features of the folder assembly in accordance with the present invention are set forth with particularity in the appended claims, a full and complete understanding of the invention may be had by referring to the detailed description of the preferred embodiment Which is set forth subsequently, and as illustrated in the sole drawing FIGURE which is a schematic side elevation view of a folder assembly for a printing press in accordance with the present invention.

DESCRIPTION OF THE PREFERRED EMBODIMENT

Referring now to the sole drawing figure, there may be seen a preferred embodiment of a folder assembly for a printing press in accordance with the present invention. A cylinder portion of the folder assembly utilizes a collection cylinder 1 in cooperation with a cutting cylinder 2 to sever a paper ribbon 13, which ie being fed in the direction indicated by arrow B, into a plurality of ribbon segments. These ribbon segments are then conveyed to a folding jaw cylinder 26 which is also in cooperation with the collection cylinder 1.

The cutting knife or cutting blade cylinder 2 has two diametrically opposed cutting knives or blades 3 on its peripheral surface. These cutting blades 3 cross-cut or sever the paper ribbon 13 into a plurality of ribbon segments by cooperative engagement with one of several counter cutting grooves 4 or devices on the periphery of the collection cylinder 1. This collection cylinder 1 will typically have three or five cutting groove devices 4, a similar number of grippers 5 and a similar number of folding blades, which are not specifically shown. Such collection cylinders are generally well known in the art. As is also known in the art, the collection cylinder 1 can be adjusted to various production formats, The collection cylinder 1 rotates in a clockwise direction, as indicated by the arrow A in the sole drawing figure. A paper ribbon 13, which has been printed by one or more printing units in the printing press, passes through cooperating drawing rollers 6 and 7 in the direction indicated by the arrow B. The paper ribbon 13 is then engaged by a belt conveyor assembly, generally at 8, in accordance with the present invention. This belt conveyor assembly 8 is located generally between the drawing rollers 6 and 7 and an intake point 16 where the collection cylinder 1 and the cutting cylinder 2 engage each other. The belt conveyor assembly 8 utilizes a plurality of axially spaced endless belts 15. These are guided around and supported by spindles or rollers 9, 10, 11, and 12 which define a somewhat triangular path of travel for the endless belts 15. The roller 11, which is positioned immediately adjacent the intake point 16, is driven by the cutting cylinder 2 in a suitable manner which is not specifically shown. The base of the triangular path of travel of the endless conveyor belts 15 extends from a point just downstream, in the direction of paper ribbon travel, from the drawing rollers 6 and 7 to Just before the intake point 16. In a modification, the belt conveying system, as depicted in dot-dash lines at 17, may have a larger triangular travel path so that the base leg of this enlarged travel path starts before, in the direction of paper ribbon travel, the drawing rollers 6 and 7. In this enlarged belt conveyor assembly 17, axially spaced endless belts 19 are guided and supported by spaced rollers or spindles 10, 11, 12 and 18. In this configuration, the roller 18 is situated before the drawing rollers 6 and 7, and the roller 11 closest to the intake point 16 again is driven from the cutting cylinder 2 and operates as the drive roller for the belt conveyor assembly 17. In the larger base configuration of the belt conveyor assembly 17 of the present invention, the axially spaced belts 19 pass between the drawing rollers 6 and 7.

As may be seen in the sole drawing figure, a portion of the base portion of the path of travel of the endless belts 15 or 19 of the belt conveyor assembly 8 or 17 wraps around the periphery of the collection cylinder 1. This belt enwrapment has a point of inception or a start of wrap at 21 and a point of completion or an end of wrap 22. It will be understood that the start of the wrap 21 and the end of the wrap 22 are actually axially extending lines which extend across the periphery of the collection cylinder. An angle of wrap $\alpha$ is the angle subtended by radially extending lines from an axis of rotation 23 of the collection cylinder 1 out to the lines 21 and 22 for the start and end of the enwrapment of the endless belts 15 or 19 of the belt conveyor systems 8 or 17 about the periphery of the collection cylinder 1. In the folder assembly of the present invention, this wrap angle is generally between 8° and 40° and is preferably between 20° and 40°. This wrap angle is sufficient to prevent a paper ribbon being cut by the cutting cylinder and the collection cylinder from springing back in a direction opposite to the direction of paper ribbon travel.

Again referring to the sole drawing figure, a generally conventional conveyor belt 24 is positioned after, in the direction B of transport of the paper ribbon 13, the point of cooperation of the cutting blade 3 and the counter cutting device 4. This conveyor belt 24 urges the ribbon segments, which have been cut and which are held by the grippers 5 on the collection cylinder 1, in the direction of the folding-jaw cylinder 26. As was indicated previously, the collection cylinder 1 is capable of being adjusted to handle various formats. The adjustability of the collection cylinder may be in accordance with the teachings of the German Patent No. DE-PS 16 11 292 referred to previously. The draw on the paper ribbon 13 which is a result of the advance of the collection cylinder 1 and the conveyor belt 24 results in the imposition of a prestress on the incoming paper ribbon 13.

As the continuous paper ribbon 13 advances toward the intake point 16, its leading edge is grasped by a gripper assembly 5 on the collection cylinder 1. The still unsevered web then passes through the intake point 16 and is held between the collection cylinder 1 and the belt conveyor 24 which, as discussed above, creates a prestress in the paper ribbon 13. As the next cooperating cutting knife 3 and counter cutting device 4 cooperate to sever the ribbon 13 to thereby form a ribbon segment and a new paper ribbon leading edge, this prestress in the paper ribbon will tend to cause the newly created leading edge of the paper ribbon 13 to spring back toward the drawing rollers 6 and 7. Such a leading edge spring back could possibly cause the now leading edge of the uncut paper ribbon 13 to retract to a point where it could not be gripped by the next gripper 5. In accordance with the present invention, the placement of the belt conveyor assembly 8 or 17 in engagement over a wrap angle with the surface of the collection cylinder prior to the intake point 16 holds the uncut paper ribbon 13 so that it cannot spring back. The placement of the drive roller 11 immediately adjacent the intake point 16 between the cylinders 1 and 2 and the provision of the wrap angle in the region 21 to 22 adjacent the intake point 16 securely holds the leading portion of the paper ribbon 13 against the collection cylinder 1 and prevents any possible spring back of the paper ribbon 13 after it has been cross-cut.

While a preferred embodiment of a folder assembly for a printing press in accordance with the present invention has been set forth fully and completely hereinabove, it will be apparent to one of skill in the art that a number of changes in, for example, the specific sheet grippers, the drive assemblies for the cylinders, the types of printing presses and the like could be make without departing from the true spirit and scope of the present invention which is accordingly to be limited only by the following claims.

I claim:

1. A cylinder portion of a folder assembly usable to cut and fold a paper web in a web-fed rotary printing machine, said cylinder portion comprising:

a pair of cooperating drawing rollers for engagement of said paper web;

a collection cylinder having a peripheral surface provided with counter cutting devices and sheet grippers, said collection cylinder receiving a leading portion of said paper web from said pair of cooperating drawing rollers, said sheet grippers gripping a leading edge of said leading portion of said paper web;

a cutting cylinder having sheet cutting blades, said sheet cutting blades on said cutting cylinder contacting said counter cutting devices on said peripheral surface of said collection cylinder at an intake point to sever said leading portion of said paper web into segments; and a belt conveyor system located adjacent said collection cylinder and intermediate said pair of drawing rollers and said intake point and contacting said leading portion of said paper web disposed on said peripheral surface of said collection cylinder before, in a direction of paper web travel, said intake point formed by said contact of said sheet cutting blades on said cutting cylinder with said counter cutting devices on said collection cylinder, said collection cylinder and said belt conveyor system imparting a prestress in said direction of paper web travel to said leading portion of said paper web, said belt conveyor system contacting said prestressed leading portion of said paper web disposed on said peripheral surface of said collection cylinder only before said intake point and through an angle of wrap sufficient to prevent said prestressed leading portion of said paper web being cut by said cutting cylinder and said collection cylinder at said intake point after said belt conveyor system from springing back along said collection cylinder in a direction opposite to said direction of paper web travel prior to the gripping of a newly created leading edge of said prestressed paper web by said sheet grippers on said collection cylinder in order to allow said sheet grippers to grip said newly created leading edge.

2. The cylinder portion of a folder assembly of claim 1 wherein said belt conveyor system is supported and guided by a plurality of rollers including a drive roller positioned immediately adjacent said intake point.

3. The cylinder portion of a folder assembly of claim 1 wherein said pair of cooperating drawing rollers are positioned intermediate a first, in said direction of paper web travel, end of said belt conveyor system and said intake point.

4. The cylinder portion of a folder assembly of claim 1 wherein said angle of wrap is between 20° and 40°.

5. The cylinder portion of a folder assembly of claim 1 wherein said angle of wrap is between 8° and 40°.

* * * * *